US006857583B2

(12) United States Patent
Attar

(10) Patent No.: US 6,857,583 B2
(45) Date of Patent: Feb. 22, 2005

(54) BOAT/RV MOUNTED PRESSURE-WASH SYSTEM

(76) Inventor: Robert A. Attar, 6587 Chelsea Bridge, West Bloomfield, MI (US) 48322

( * ) Notice: Subject to any disclaimer, the term of this patent is extended or adjusted under 35 U.S.C. 154(b) by 174 days.

(21) Appl. No.: 10/255,519

(22) Filed: Sep. 26, 2002

(65) Prior Publication Data

US 2004/0061000 A1 Apr. 1, 2004

(51) Int. Cl.[7] ..... B05B 9/04

(52) U.S. Cl. ..... 239/332; 239/124; 239/195; 239/197; 239/289; 239/302; 239/526

(58) Field of Search ..... 239/124, 127, 239/195, 197, 198, 302, 332, 525, 532, 526, 725, 289

(56) References Cited

U.S. PATENT DOCUMENTS

| | | | | |
|---|---|---|---|---|
| 3,139,060 A | * | 6/1964 | Dane | 239/725 |
| 3,246,845 A | | 4/1966 | Techler et al. | |
| 3,306,213 A | * | 2/1967 | Fritz | 239/195 |
| 3,481,544 A | * | 12/1969 | Jackson | 239/130 |
| 3,543,787 A | | 12/1970 | Tepper | |
| 3,942,457 A | * | 3/1976 | Keyes et al. | 114/61.1 |
| 4,813,627 A | | 3/1989 | Nelson | |
| 5,100,058 A | | 3/1992 | Wei | |
| 5,230,471 A | | 7/1993 | Berfield | |
| 5,344,075 A | | 9/1994 | Springer et al. | |
| 5,667,141 A | | 9/1997 | Suttner | |
| 5,749,526 A | | 5/1998 | Laabs et al. | |
| 5,975,423 A | | 11/1999 | Rice et al. | |
| 6,189,811 B1 | | 2/2001 | Rudy | |
| 6,227,460 B1 | * | 5/2001 | Funk et al. | 239/131 |
| 6,416,009 B1 | | 7/2002 | Iaciofano et al. | |

* cited by examiner

*Primary Examiner*—Steven J. Ganey
(74) *Attorney, Agent, or Firm*—Harness, Dickey & Pierce, PLC

(57) ABSTRACT

A boat or recreational vehicle (RV) mounted pressure washing system fully plumbed and integrated electrically with the boat or RV, and located remotely therewithin according to user's preferred mounting location such as the bilge, engine compartment or a supply cabinet. The system provides the user with a high pressure supply of water for washing, rinsing, etc. by means of a pump, water reservoir and fully retractably high pressure hose, to which a nozzle of choice may be quickly attached or removed when not in use. The pressure hose is of significant length to provide for the pressure washing of the entire vehicle and surrounding areas by the user, whereby when not in use is fully retractable into the boat or RV for storage.

12 Claims, 4 Drawing Sheets

BOAT/RV MOUNTED PRESSURE-WASH SYSTEM

FIELD OF THE INVENTION

This invention relates to a pressurized washing system. More particularly, this invention relates to a boat-mounted pressurized washing system for permanent installation and full integration into a boat or recreational vehicle for the purposes of washing the same and surrounding areas by delivering water expelled under high-pressure.

BACKGROUND OF THE INVENTION

Pressurized washing systems are relatively common. It is well known that the washing efficiency of a liquid such as water increases when delivered to the desired object to be washed under a higher pressure stream rather than at lower pressures. One common application and desired use for a pressurized-washing means is in the area of washing boats or recreational vehicles (RVs) such as motor homes and trailers, due to their tendencies of becoming frequently defiled, from salt, insects, birds and dirt from infinite sources.

It is old in the art to provide a portable means of supplying water under high pressure for the washing of such vehicles and the like. For example, U.S. Pat. No. 6,189,811, issued Feb. 20, 2001 to David Rudy, describes and illustrates a portable pressure washing system having a solar-voltaic power supply, to deliver a pressurized stream of water.

U.S. Pat. No. 5,975,423, issued Nov. 2, 1999 to Terrence D. Rice, teaches of a portable, fully self-contained pressure wash-down system, wherein the components are contained in a single enclosure, for storage and transportation thereof. Unfortunately, due to the weight of the enclosed components comprising the washing unit, i.e. battery, pump and motor unit, as well as the hoses, water supply means, and various nozzles, the system is rather heavy and burdensome to transport long distances.

Along these same lines, in an effort to help minimize the weight of these portable systems and make them less burdensome, smaller pumps implementing less heavy motors are generally utilized, thereby providing a significantly less powerful stream of water than may often be desired for a given purpose. Furthermore, the length of hose incorporated with these portable systems is limited to the small amount of storage space provided within the unit, often requiring the operator to frequently move the pressure-washing system from area to area when washing a large boat or RV.

Because of the aforementioned shortcomings of the prior art in this field, there is a need for a pressurized washing system with a more powerful pumping system, providing increased pressure delivery over the portable systems for use on vehicles such as boats or RVs, which can be permanently mounted and incorporated within such vehicles eliminating the burdensome transportation, unpacking, and setting up required by the portable systems of prior art.

SUMMARY OF THE INVENTION

It is therefore an object of the present invention to provide a self contained pressure washing system to be permanently mounted within a boat or in the alternative, an RV.

Another object of the present invention to provide a pressure washing system which can be fully integrated and hard wired into a boat's generator or shore-power supply, eliminating the need for extension cords or alternative power means.

It is also an object of the present invention to provide a pressure washing system for a boat having its own fresh water reservoir, in connection with an exterior filling means such as a remote quick connector fitting on the side of the vessel.

Another object of the present invention is to provide for an easily storable supply of hose, long enough to allow the user to wash all aspects of the boat or vehicle, eliminating the burden of coiling and storing lengthy hoses.

A further object of the present invention is to provide an easily accessible location on the boat or RV to access the remotely stowed hose supply, and having a quick-connector means for attachment of a spray nozzle thereto.

Finally, it is an object of the present invention to provide a fully integrated pressure washing system which can easily be incorporated into both newly manufactured vehicles, and retrofitted into older, existing boats or RVs, without sacrificing a significant amount of space therewithin.

The foregoing objects are accomplished in the preferred embodiment of the invention by providing a boat mounted pressure washing system, to be fully integrated and mounted within the boat. The pressure washing system comprises an internally mounted pump and drive unit, a fresh water reservoir, and a high pressure hose of predetermined length, and may be mounted in a variety of locations within the boat, such as the bilge, engine room, or storage cabinet. The fresh-water reservoir is hooked up to an external filling means having a quick connector located remotely on side of the boat for attachment of a dock-side hose, and supplies water to the pump unit. The output from the pump is connected to the high pressure hose, storable on an adjacent or remotely located recoiling hose reel. The length of the hose is determined by the user's individual preference, but is generally long enough to reach the entire length of the boat and immediate surrounding areas such as the dock.

The distal end of the hose is guided through a sleeve running inside the boat, and terminates in a quick-connection fitting positioned within an aperture on the exterior surface of the boat for connection with a nozzle of preference. When desired to activate and use the pressure wash system, the operator simply energizes the pump unit by turning on a corresponding power supply switch on the fuse panel of the boat, connects a nozzle to the fitting located on the end of the hose accessible through the aperture in exterior surface of the boat, and draws out the desired length of remotely stored hose to begin use.

Once finished, the user simply shuts off the power switch, removes the nozzle, and with the assistance of the spring-recoiled hose reel, guides the hose back through the access aperture located within the interior spaces of the boat.

As stated above, further areas of applicability of the present invention will become apparent from the detailed description provided hereinafter, such as integrating the system into an RV or trailer. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
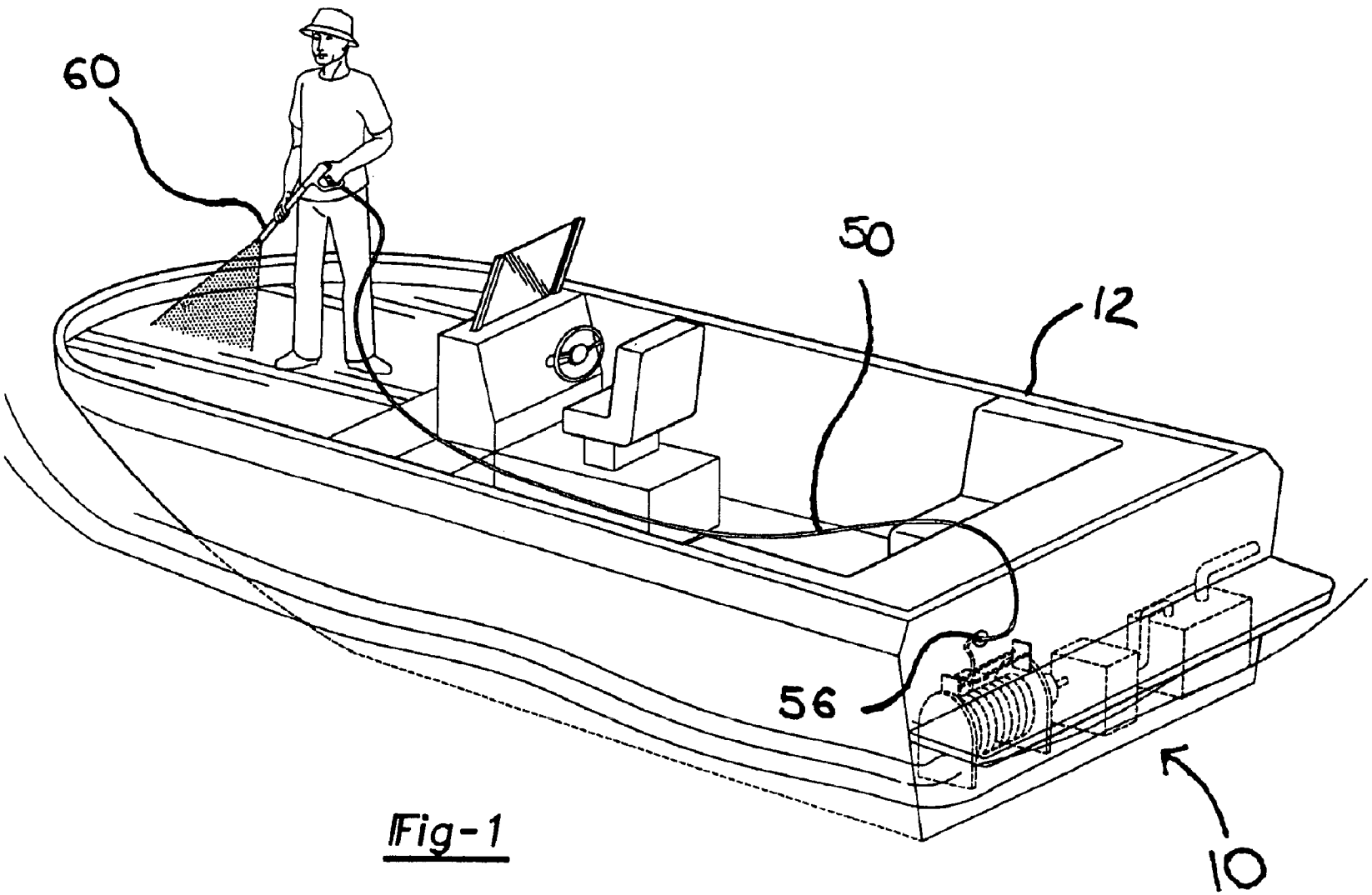
FIG. 1 is a perspective view of the pressure wash system in accordance with the present invention installed and in use on a boat.

The following description of the preferred embodiment(s) is merely exemplary in nature and is in no way intended to limit the invention, its application, or uses. Referring now to FIG. 1, the boat mounted pressure wash system 10 is shown, incorporated and in use with a boat 12. The mounting location within the boat 12, and actual type of boat 12 with which the pressure wash system 10 is shown is not intended to limit the scope of the present invention's applications. Specifically, in an alternative application not illustrated, the pressure wash system 10 of the present invention may be mounted in conjunction with a recreational vehicle (RV) or camper trailer.

Figure 2:
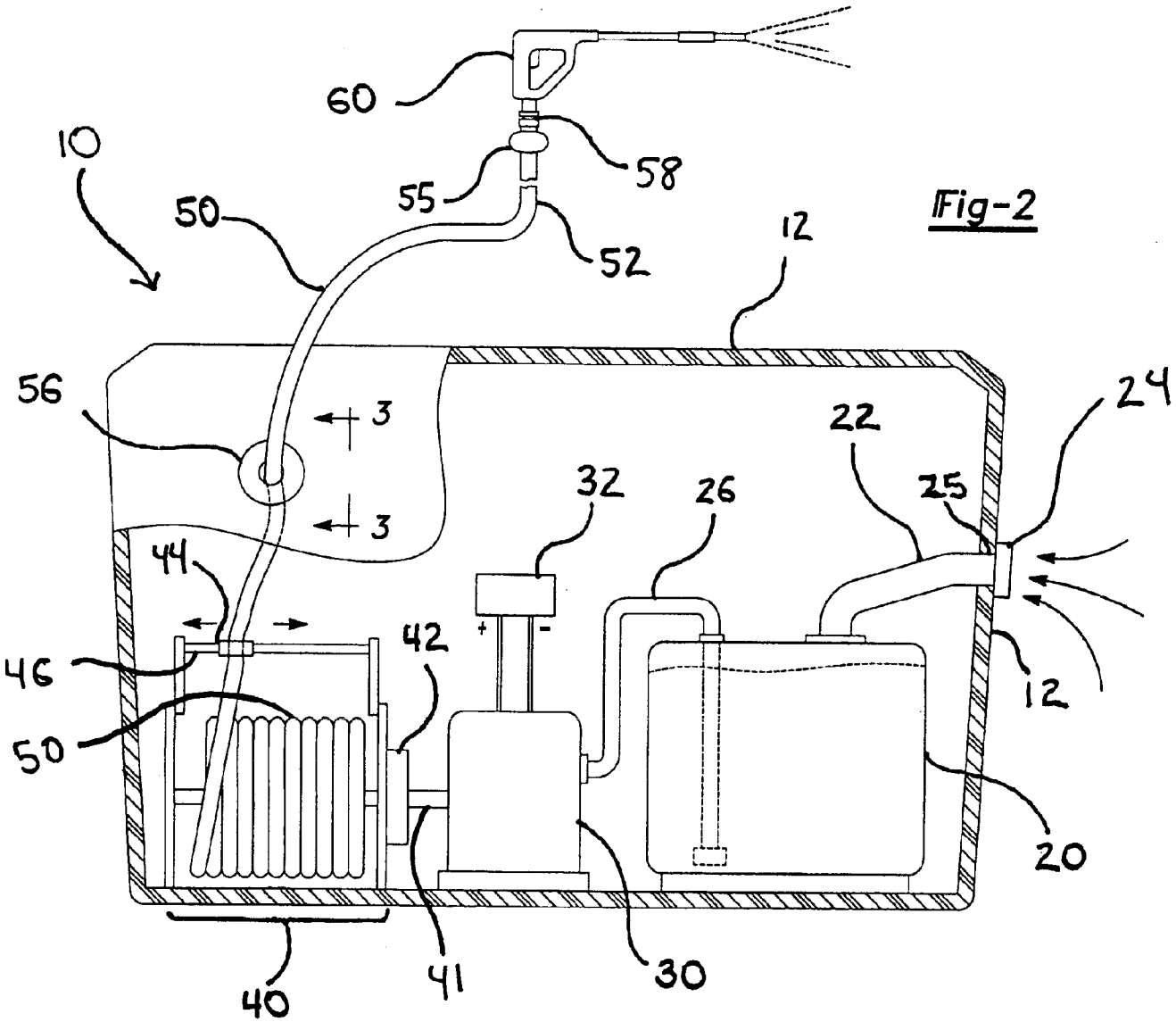
FIG. 2 is a partial sectional view of the system, illustrating each of the system components.

Referring now to FIGS. 1 and 2 together, the individual components of the pressure wash system 10 are more clearly illustrated. Comprising four primary components: a fresh water reservoir 20, a pressurizing pump 30, a hose storage reel 40, and a high pressure hose 50 of predetermined length, the pressure wash system 10 may be mounted either unitarily as a whole, or separated so as to allow individual components to be remotely located, providing more flexibility for the system 10 to be adaptable to individual boat applications.

The fresh water reservoir 20 used for holding a supply of water for the pressure wash system 10, has a predetermined volume and is mounted within the interior spaces of the boat, such as the bilge or engine compartment. Other mounting locations such as within a storage cabinet or closet may also be utilized depending upon the users preference, available space and ease of accessibility. The reservoir has a general water supply line 22 connecting between the reservoir 20 and the outside surface of the boat 12, whereby terminating in a universal hose fitting 24. The reservoir 20 is easily refilled with fresh water when depleted, by attaching a hose from the dock-side water supply to the universal fitting 24 located on the outside of the boat 12. The installation of the water supply line requires only minor modification to the boat 12 in terms of cutting a single aperture 25 in the desired, location on the boat 12, proximal the mounted reservoir 20 within the boat, and routing the supply line 22 between the reservoir 20 and the fitting 24 mounted through the aperture 25.

While specific reference has been made above to using a dockside water for the water source utilized by the pressure wash system, the present invention is intended to further encompass applications where the water source for the wash system is provided by water stored in the built in on-board water tanks, commonly provided on both marine vessels and recreational vehicles.

The reservoir 20 further connects to a pump supply line 26 which feeds water stored within the reservoir 20 to the pressurized pump 30 during use of the pressure wash system 10. The pressurized pump 30 is of a high pressure liquid pumping unit readily available on the market, and generally will be one universally used for all applications of the system 10. Alternatively, a plurality of different pumps 30 may be implemented, depending on individual users performance preference, but regardless of which type of pump 30 is utilized in each installation, the drive motor implemented in the pump will be of marine grade, having sparkless brushes for marine applications. The pressurized pump 30 motor is designed to be hard wired directly into the boat's AC shore supply or generator power supply 32, eliminating any need for extension cords, or additional circuitry when energizing the pump 30 motor. By providing a means for the pump 30 to be energized with either AC shore power or generator power, the pressure washing system 10 may be utilized while the boat 12 is out to sea, thereby supplying the pump 30 with power from the boat's generator. In the alternative, while the boat is docked, the pressure washing system 10 may be utilized wherein the pump 30 may be energized with AC shore power supplied to the boat by a power cord from the shore, thereby conserving fuel in not requiring the boat's 12 generator to be operating continuously. A circuit breaker dedicated to the pressure wash pump 30 is remotely located on the fuse panel of the boat 12, whereby the power supply 32, either shore power or generator provides for energizing the pump 30 when the user activates the circuit.

The pump 30 supplies a pressurize supply of water from the reservoir 20 to a high pressure hose 50 of predetermined length by means of a pressure supply line 41 connected to the permanently mounted hose reel 40 located inside the boat 12 either proximal to the pump 30, or located elsewhere within the boat. The hose reel 40 of which several currently marketed designs may be utilized with the system 10, releasably stores the high pressure hose 50 in a series of coils upon the reel, and has a spring loaded or electromechanically assisted recoiling means 42 for selectively winding or unwinding the hose 50 from the hose reel 40. The recoiling means 42 allows the user to withdrawal the hose 50 from the reel 40 when so desired, lock the reel at any position to utilize the pressure wash system 10, and subsequently provide for returning the hose 50 to the reel 40 when finished. The hose reel 40 also depicted in FIGS. 4 and 5, has a slidable guide means 44 attached to a lateral track 46 implemented into the reel 40, for guiding the hose 50 evenly onto the hose reel 40 during recoiling. The specific length of the high pressure hose 50 is predetermined by the user's preference and available storage space, but generally when fully extended, will be of a length significantly longer than the length of the boat 12 upon which the system 10 is mounted, thereby providing for enough hose 50 length to wash the entire boat 12 and surrounding areas.

Figure 3:
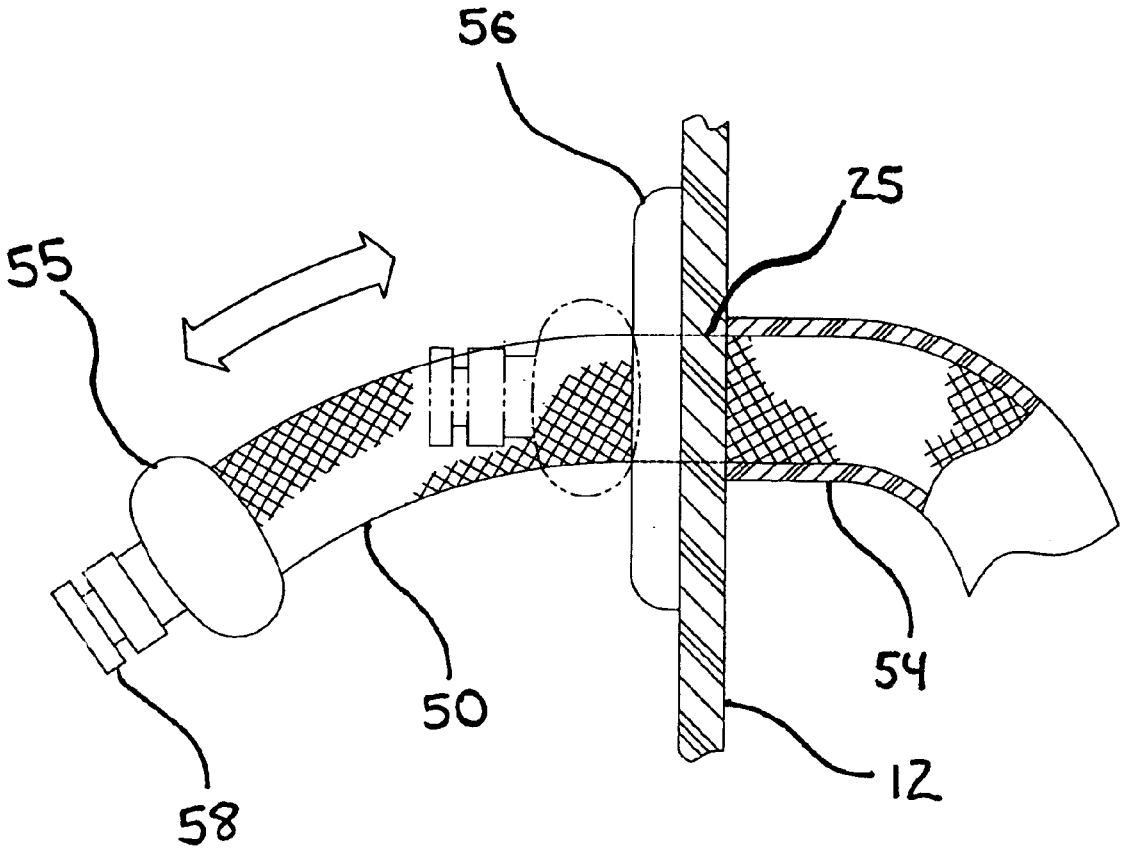
FIG. 3 is a partial sectional view taken along line 3 of FIG. 2, showing the hose aperture and pressure hose positioned there through, within the side of a boat.
Figure 4:
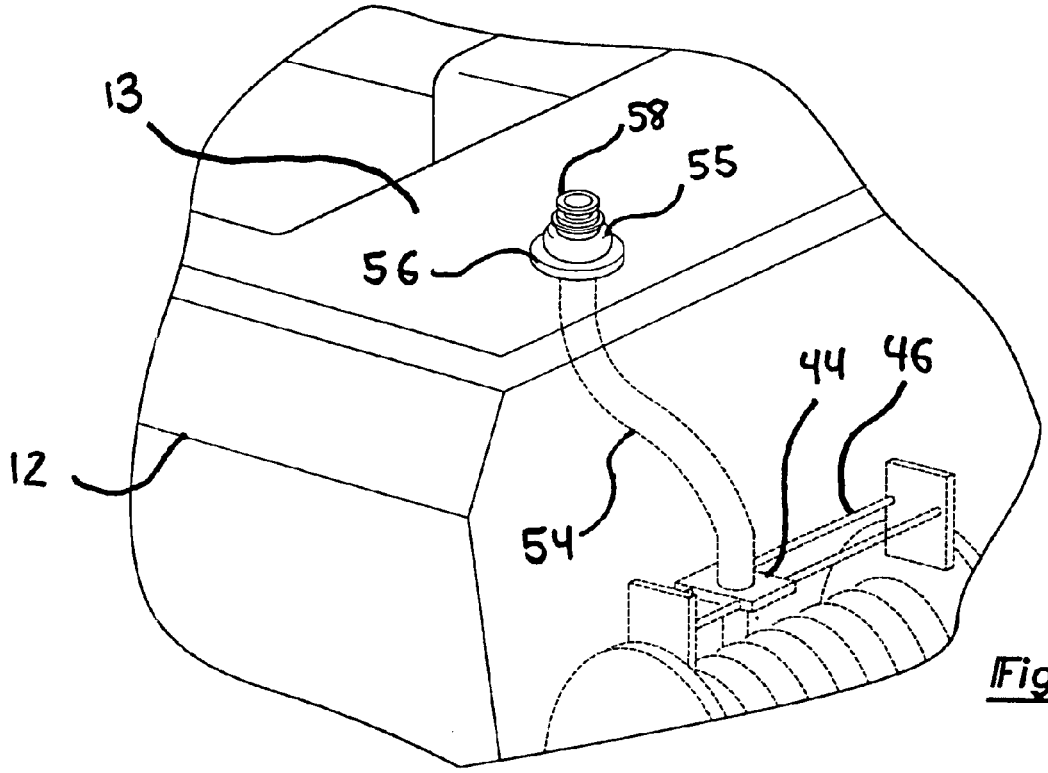
FIG. 4 illustrates a perspective view of the hose aperture of one embodiment of the present invention.
Figure 5:
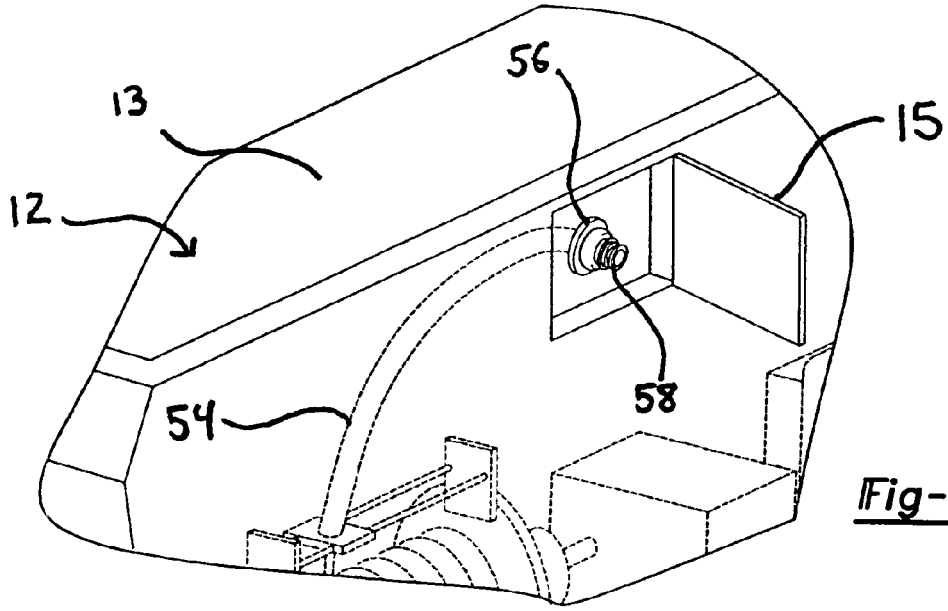
FIG. 5 is a perspective view of the hose aperture location, illustrating a second embodiment of the present invention.

Referring now to FIGS. 3, 4, and 5, the distal end 52 of the high pressure hose 50 is fed from the reel 40 through a flexible sleeve 54 having a greater inside diameter than that of the high pressure hose 50. The sleeve 54 provides for a guiding means to slidably guide the high pressure hose 50 from the remotely mounted hose reel 40 to an aperture 56 located remotely outside the boat 12. The distal end 52 of the hose 50 outside the boat 12 terminates in a quick release fitting 58 for attachment to a removable spray nozzle 60, and further has a recoil-stop means 55 located on the distal end, providing for a preventative means of full retraction of the hose 50 into the inside of the boat 12 due to the recoiling means of the hose reel 40. The recoil-stop means 55 comprises an annular bushing of rubber or plastic having a greater diameter than the aperture 56 thereby preventing full retraction of the distal end 52 of the hose 50 into the boat 12.

Referring to FIGS. 4 and 5, the aperture 56 and corresponding high pressure hose 50 access may be positioned in a variety of locations on the outside of the boat 12 pursuant to the users preference and accessibility, whereby installation requires only minor modification in terms of cutting a single hole in the desired, remote location on the boat 12. Specifically, FIG. 4 shows the hose access aperture 56 on a horizontal deck surface 13 of a boat 12, wherein an alternative embodiment of the present invention, FIG. 5 shows the hose access aperture concealable within a cabinet or access panel 15.

As mentioned above, the scope of the present invention is not intended to be limited to installations on boats of either power or sail. The pressure wash system 10 may be just as easily adapted for mounting in conjunction with a recreational vehicle (RV) or camper trailer and can be installed during the manufacture of new vehicles, as well as being retrofitted into older, existing boats or RVs.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A boat mounted pressure washing system for washing down a boat and surrounding areas comprising:

a remote pressure pump unit attached to and hardwired into said boat;

a remote fresh water holding reservoir;

a high pressure hose of predetermined length;

a hose storage means for remotely storing said hose when not in use;

a hose guide sleeve, running from said storage means to outside of said boat, through which said hose slides in and out of said boat;

a quick release nozzle for attaching to said hose;

a means for installing said boat mounted pressure washing system into said boat.

2. The boat mounted pressure washing system of claim 1, wherein said pressure pump unit and said water storage reservoir are mounted proximal to each other, remotely within the interior of said boat.

3. The boat mounted pressure washing system of claim 1, wherein said pressure pump unit is hardwired and integrated with said boats AC shore-power supply, having a designated circuit breaker for said pressure washing system.

4. The boat mounted pressure washing system of claim 1, wherein said pressure pump unit is hardwired and integrated with said boats generator power supply, having a designated circuit breaker for said pressure washing system.

5. The boat mounted pressure washing system of claim 1, wherein said water holding reservoir provides said pressure pump with water stored within said reservoir through a pump line.

6. The boat mounted pressure washing system of claim 1, wherein said water holding reservoir is in connection with a water supply line, said supply line terminating in a universal quick connector outside of said boat for refilling said reservoir with water from a dockside water supply.

7. The boat mounted pressure washing system of claim 1, wherein said hose is a predetermined, length, greater than overall length of said boat, said hose is located through aperture in said boat, said hose terminating outside said boat with said quick-release fitting for attachment of said quick release nozzle, said hose having means of preventing said quick-release fitting from slipping through said aperture, into said interior of said boat.

8. The boat mounted pressure washing system of claim 1, wherein said hose storage means is mounted remotely within the interior of said boat, said storage means comprising a hose reel.

9. The boat mounted pressure washing system of claim 8, wherein said hose reel comprises:

a hub;

a spring-wound automatic recoiling means;

a hose guide for evenly winding and distributing said hose onto said reel;

a ratchet-locking means, providing selective locking of said recoiling means preventing winding of said hose onto said hub;

a connection means for attaching said hose to said pressure pump.

10. The boat mounted pressure washing system of claim 8, wherein said hose reel comprises:

a hub;

an electric powered recoiling means;

a hose guide for evenly winding and distributing said hose onto said reel;

a control means, providing selective winding and unwinding of said hose from said hub;

a connection means for attaching said hose to said pressure pump.

11. The boat mounted pressure washing system of claim 1 wherein said means for installing said boat mounted pressure washing system is during the initial fabrication of said boat.

12. The boat mounted pressure washing system of claim 1 wherein said means for installing said boat mounted pressure washing system is retrofitting and mounting said pressure-washing system into a pre-manufactured boat.

* * * * *